US009537264B2

(12) United States Patent
Wang et al.

(10) Patent No.: US 9,537,264 B2
(45) Date of Patent: Jan. 3, 2017

(54) ELECTRICAL CONNECTOR

(71) Applicant: Tyco Electronics (Shanghai) Co. Ltd., Shanghai (CN)

(72) Inventors: Ning Wang, Shanghai (CN); Xiang Xu, Shanghai (CN); Hongjun Yin, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 14/809,676

(22) Filed: Jul. 27, 2015

(65) Prior Publication Data

US 2016/0028192 A1 Jan. 28, 2016

(30) Foreign Application Priority Data

Jul. 28, 2014 (CN) ..... 2014 2 0419055 U

(51) Int. Cl.

| | |
|---|---|
| ***H01R 13/648*** | (2006.01) |
| ***H01R 13/6581*** | (2011.01) |
| ***H01R 13/6597*** | (2011.01) |
| *H01R 4/64* | (2006.01) |
| *H01R 9/03* | (2006.01) |
| *H01R 13/6592* | (2011.01) |
| *H01R 13/74* | (2006.01) |

(52) U.S. Cl.

CPC ..... *H01R 13/6581* (2013.01); *H01R 13/6597* (2013.01); *H01R 4/64* (2013.01); *H01R 9/034* (2013.01); *H01R 13/6592* (2013.01); *H01R 13/748* (2013.01)

(58) Field of Classification Search

CPC ..... H01R 13/6597
USPC ..... 439/607.34, 607.5, 607.51, 101
See application file for complete search history.

(56) References Cited

U.S. PATENT DOCUMENTS 6,319,063 B1 * 11/2001 Huang ..... H01R 13/65802 439/607.34
7,922,532 B2 * 4/2011 Su ..... H01R 13/648 439/607.23
8,066,531 B2 * 11/2011 Kanatsu ..... H01R 13/6588 439/607.34
8,997,345 B2 * 4/2015 Liu ..... H01R 43/24 29/825

* cited by examiner

*Primary Examiner* — Phuong Dinh
(74) *Attorney, Agent, or Firm* — Barley Snyder

(57) ABSTRACT

The present disclosure provides an electrical connector adapted to connect a cable having a metal braid layer with an electrical apparatus having an apparatus housing. The electrical connector includes a body adapted to be mounted on the apparatus housing; a cover fitted on the body; a metal shielding member fitted on the body and partially covered by the cover; and a terminal module arranged within the body. The terminal module comprises a grounding terminal for a grounding connection via the apparatus housing or a grounding wire of the electrical apparatus and a plurality of signal terminals for supplying electrical current from the cable to the electrical apparatus. The metal shielding member comprises a clamping portion adapted to clamp and electrically contact the metal braid layer and an elastic terminal electrically contacting the grounding terminal.

23 Claims, 5 Drawing Sheets

ELECTRICAL CONNECTOR

CROSS-REFERENCE TO RELATED APPLICATION

This application claims the benefit of the filing date under 35 U.S.C. §119 (a)-(d) of Chinese Patent Application No. 201420419055.1 filed on Jul. 28, 2014.

FIELD OF THE INVENTION

Embodiments of the present invention generally relate to electromagnetic shielding of an electrical connector, and particularly, to an electrical connector capable of connecting a cable to an electrical apparatus and effectively shielding electromagnetic interference.

BACKGROUND

A cable is generally connected to an electrical apparatus such as a motor via an electrical connector, so as to provide electrical current or signals to the electrical apparatus. Since there are a number of magnetic fields within the space, efficient transmission of the electrical current or signals will be adversely affected by external electromagnetic interference. Thus, electromagnetic shielding of a high voltage cable connector or a large electrical current cable connector is often of concern in a circuit connection.

In addition, with development of the electrical connector, competition grows more intense, thus the cost of the electrical connector product becomes an advantage factor. It is required to effectively improve material utilization so as to reduce cost while satisfying the electromagnetic shielding function of the product.

SUMMARY

The present disclosure provides an improved electrical connector, to which is capable of solving at least one aspect of the above problems and drawbacks in the prior art.

An object of the present disclosure is to provide an improved electrical connector which is capable of effectively shielding electromagnetic interference and improving security of the electrical connection between the cable and the electrical apparatus.

An electrical connector adapted to connect a cable having a metal braid layer with an electrical apparatus, constructed in accordance with the present invention includes a body adapted to be mounted on the electrical apparatus and a cover fitted on the body. This electrical connector also has a terminal module within the body that has a grounding terminal for a grounding connection via the electrical apparatus and a plurality of signal terminals for supplying electrical current from the cable to the electrical apparatus. An electrical connector, constructed in accordance with the present invention, further includes a metal shielding member that is fitted on the body, is at least partially covered by the cover, and has a clamping portion adapted to clamp and be in electrical contact with the metal braid layer and an elastic terminal in electrical contact with the grounding terminal of the terminal module.

BRIEF DESCRIPTION OF THE DRAWINGS

The above and other features and advantages of the present invention will become more apparent by describing in detail exemplary embodiments thereof with reference to the accompanying drawings, in which.

DETAILED DESCRIPTION OF THE EMBODIMENT(S)

Figure 1:
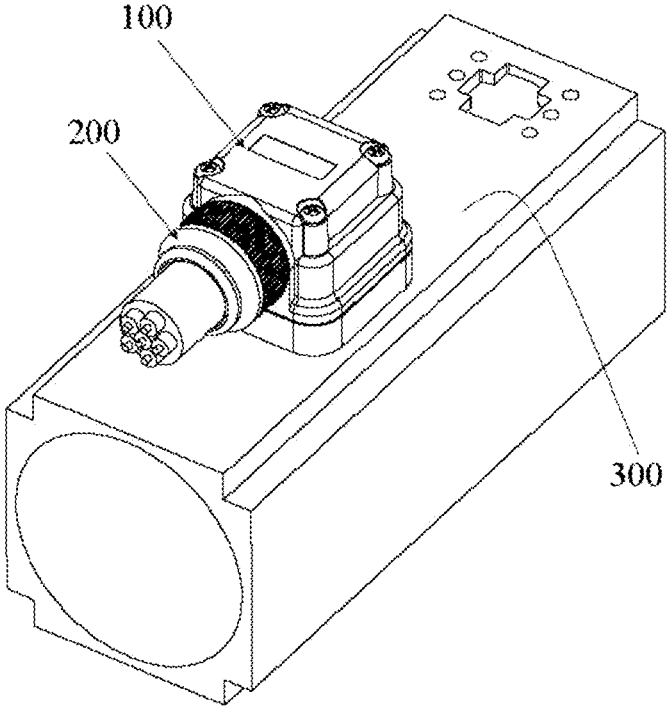
FIG. 1 is a perspective view showing an electrical connector for connecting a cable to an electrical apparatus.

Exemplary embodiments of the present invention will be described hereinafter in detail with reference to the attached drawings, wherein the like reference numbers refer to the like elements. The present invention may, however, be embodied in many different forms and should not be construed as being limited to the embodiment set forth herein; rather, these embodiments are provided so that the description of the present invention will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In one exemplary embodiment, as shown in FIG. 1, an electrical connector 100 connects a cable 200 to an electrical apparatus, such as a motor, having an apparatus housing 300 made of, for example, a metal or other conductor material, so as to transmit electrical current or signals from the cable to the electrical apparatus.

Figure 2:
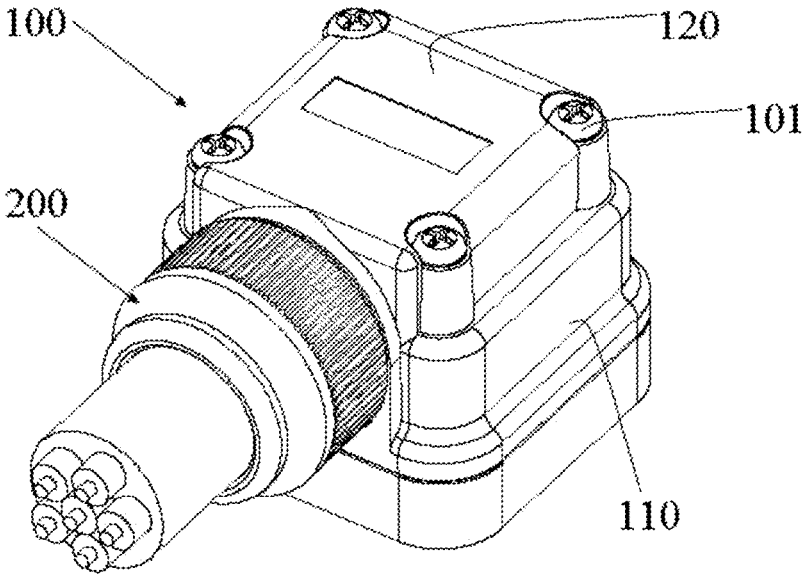
FIG. 2 is a perspective view showing an overall structure of the electrical connector shown in FIG. 1 removed from a housing of the electrical apparatus.
Figure 3:
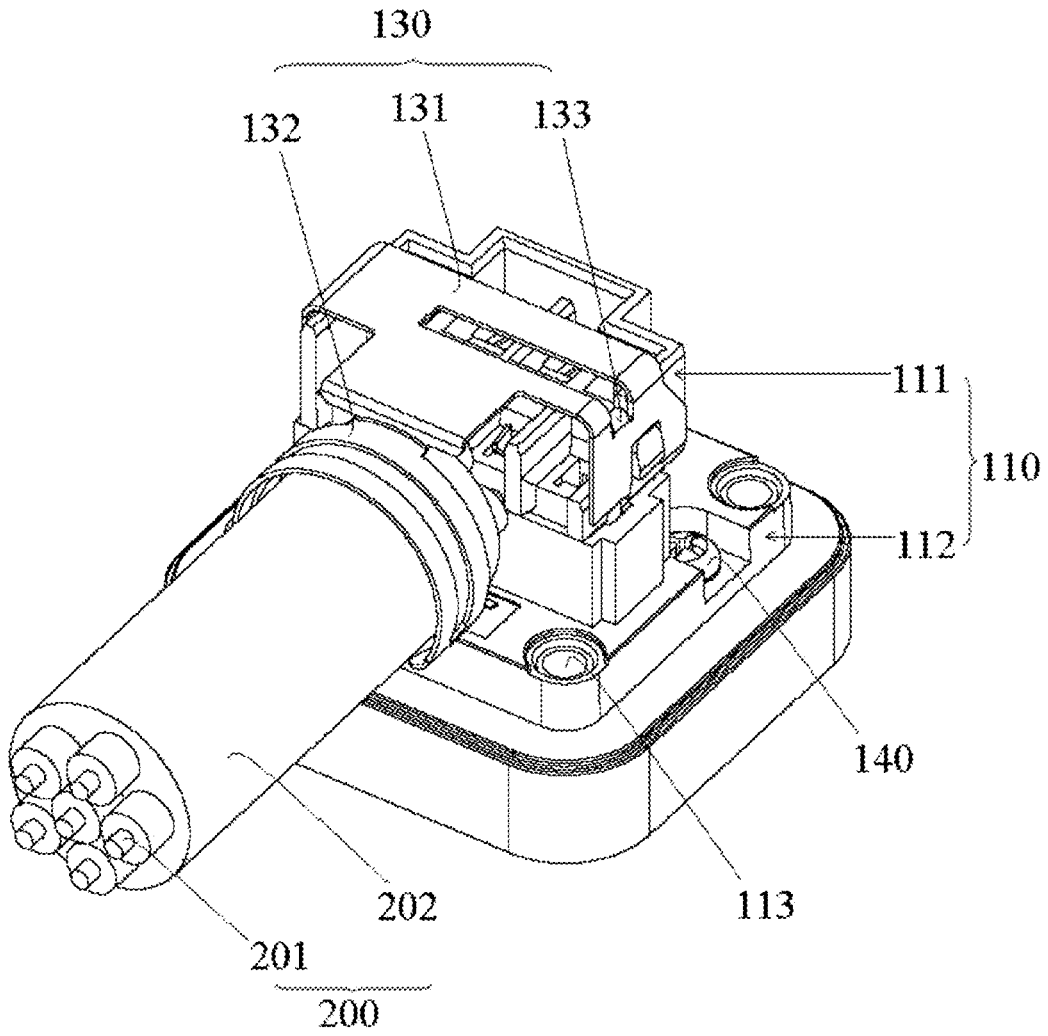
FIG. 3 is a perspective view showing internal structures of an electrical connector according to one exemplary embodiment of the present disclosure, with a cover of the electrical connector being removed.
Figure 4:
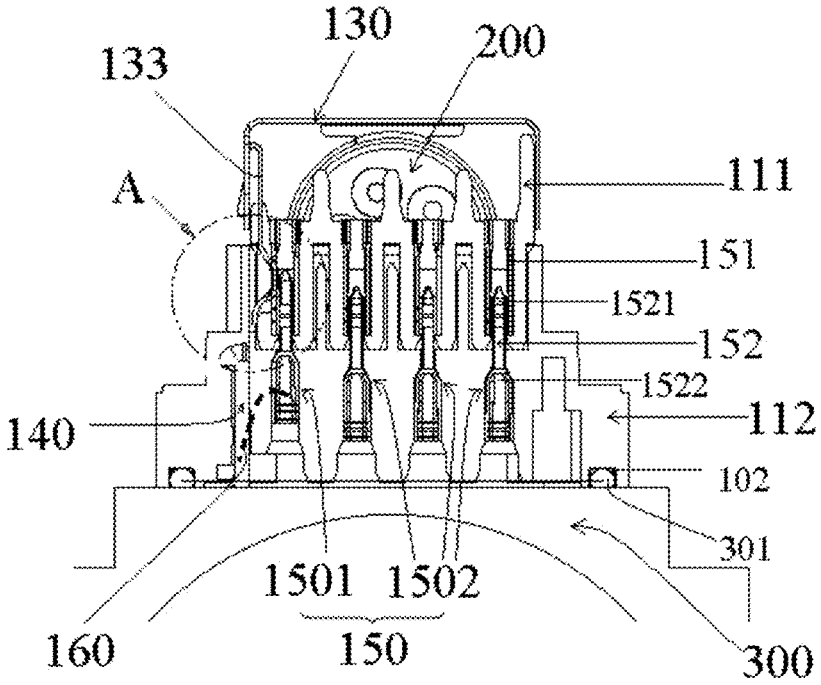
FIG. 4 is a cross-sectional view showing internal structures of the electrical connector shown in FIG. 3.

With reference to FIGS. 2-4, the electrical connector 100 comprises a body 110, a cover 120, a metal shielding member 130 and a terminal module 150. The body 110 is generally made of plastic or other insulating materials and configured to be fitted onto the apparatus housing 300, for example, fixed on the housing 300 via screws. The terminal module 150 is arranged or received within the body 110 and, at least, comprises a grounding terminal 1501 and a plurality of signal terminals 1502 adapted to be electrically connected with core wires 201 of the cable 200 (see FIGS. 2 and 3), for providing electrical current from the cable 200 to the electrical apparatus. The grounding terminal 1501 electrically contacts a part of the metal shielding member 130 and is configured for a grounding connection by means of the electrical apparatus. The metal shielding member 130 is configured to electrically contact a metal braid layer 202 (shown in FIG. 3) of the cable 200 and has a part electrically contacting the grounding terminal 1501 so as to connect the metal braid layer 202 to ground. The cover 120 is fitted on the body 110 so as to shield the terminal module 150 within the body and, at least, partially shield portions the metal shielding member 130, for example, shield portions of the metal shielding member 130 except for a clamping portion thereof for clamping the metal braid layer. Once the cover 120 is fitted on the body 110, as shown in FIG. 2, fasteners 101 are positioned to extend into fastener receiving passageways 113 to secure the cover 120 to the body 110.

In one example, the grounding terminal 1501 of the electrical connector may be electrically connected with a grounding line (not shown) of the electrical apparatus, for example, the grounding line of the electrical apparatus may be pressed and connected into the grounding terminal so as to achieve a grounding connection. As an alternative, the grounding terminal 1501 may be electrically connected with the apparatus housing 300 of the electrical apparatus. When the body 110 is fixed onto the apparatus housing 300 through metal screws 140, as shown in FIGS. 3 and 4, the grounding terminal 1501 may be electrically connected to a metal screw 140 by a metal wire or conductor 160 indicated by a rough dashed line shown in FIG. 4, so as to be grounded through the apparatus housing 300. Of course, the grounding terminal 1501 may be directly electrically connected or welded to the apparatus housing 300.

As shown in FIGS. 3 and 4, the metal shielding member 130 may comprise a clamping portion 132 adapted to clamp and electrically contact the metal braid layer 202 of the cable 200 and an elastic terminal 133 electrically contacting the grounding terminal 1501, thereby electrically connecting the metal braid layer of the cable to the grounding terminal of the electrical connector through the metal shielding member and to earth-shield, for example, and for effectively avoiding electromagnetic interference and the like which will adversely affect transmission of signal or electrical current. The configuration of the metal shielding member 130 will be described in detail below with reference to FIGS. 5-7.

Figure 5:
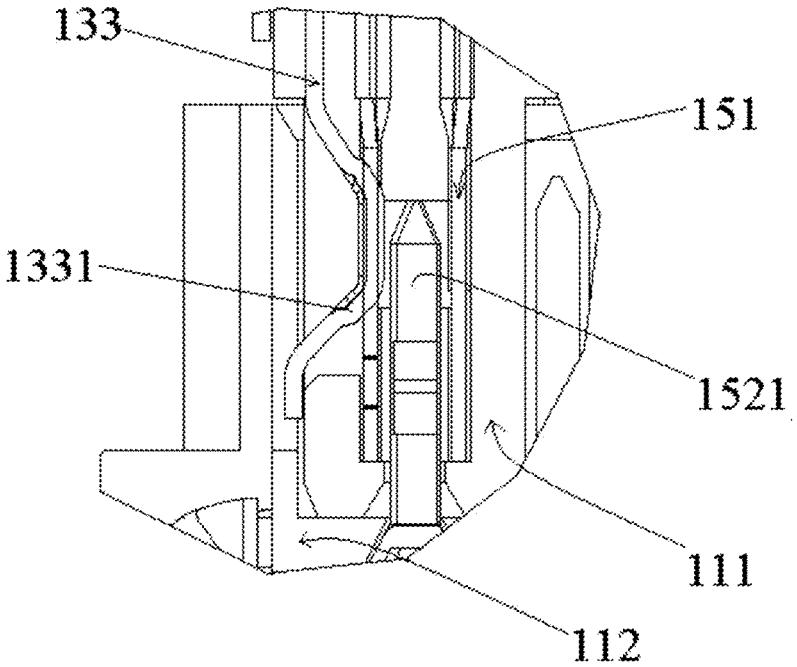
FIG. 5 is a partially enlarged cross-sectional view showing part "A" of the electrical connector shown in FIG. 4.

FIG. 4 shows internal structures of an electrical connector according to one exemplary embodiment of the present disclosure. FIG. 5 is a partially enlarged cross-sectional view showing part "A" of the electrical connector shown in FIG. 4. As shown, each of the grounding terminal 1501 and the signal terminals 1502 of the electrical connector 100 may be in the two-part form, for example, comprising a female contact member 151 and a male contact member 152 inserted in the female contact member 151. As shown in FIG. 4, the female contact member 151 may be in the form of jack and the male contact member 152 may have an insertion end 1521 inserted into the female contact member 151 and a receiving end 1522 for receiving the grounding line (not shown) of the electrical apparatus. The insertion end 1521 may be in the form of plug, while the receiving end 1522 may be in the form of jack. The female contact member of the grounding terminal 1501 electrically contacts the elastic terminal 133 of the metal shielding member 130, for example, and the elastic terminal 133 may contact an outer wall of the female contact member of the grounding terminal 1501, as shown in FIG. 5.

The male contact member of the grounding terminal 1501 is configured for the grounding connection, for example, being electrically connected with the apparatus housing of the electrical apparatus, or the grounding line of the electrical apparatus may be pressed and connected in the receiving end 1522. It will be understood by those skilled in the art that the grounding terminal and the signal terminals of the electrical connector are not limited to those shown in the figures. For example, they may be simple integral structures.

When the grounding terminal 1501 and the signal terminals 1502 of the electrical connector 100 are in the two-part form, the body 110 of the electrical connector 100 may also in the two-part form or in the split form, comprising an upper body portion 111 and a lower body portion 112. The upper body portion 111 is fitted on the lower body portion 112, for example, and is fitted and embedded within the lower body portion 112, and receives the female contact member 151 of the terminal. The male contact member 152 of the terminal is partially received within the lower body portion 112 so that the insertion end 1521 of the male contact member 152 protrudes from the lower body portion 112 so as to be inserted into the female contact member 151. In other words, when in a separate form, the female contact member 151 may be completely received within the upper body portion 111 and the receiving end 1522 of the male contact member 152 is located within the lower body portion 112, while the insertion end 1521 protrudes from the lower body portion 112.

According to one preferred embodiment of the present disclosure, the height by which the insertion end of the male contact member of the grounding terminal 1501 protrudes from the lower body portion 112 is larger than the height by which the insertion ends of the male contact members of the signal terminals 152 protrude from the lower body portion. As a result, when the upper body portion 111 is fitted on or partially inserted in the lower body portion 112, the higher insertion end of the male contact member of the grounding terminal 1501 is inserted into the corresponding female contact member before the insertion ends of the male contact members of the signal terminals 1502 are inserted into the corresponding female contact members for receiving electrical current. As a result, the cable and the electrical connector are first grounded before being electrically connected with the electrical apparatus, thereby avoiding electrical elements within the electrical apparatus from being affected by the electrostatic discharging phenomenon and thus protecting operator(s). Further, since the female contact member 151 electrically connected with the core wire of the cable does not protrude from the upper body portion 111, the operator, who grasps the upper body portion 111 when the cable is charged during connecting the cable to the electrical apparatus through the electrical connector, can be protected from getting an electric shock, thereby improving security of the electrical connector.

Figure 6:
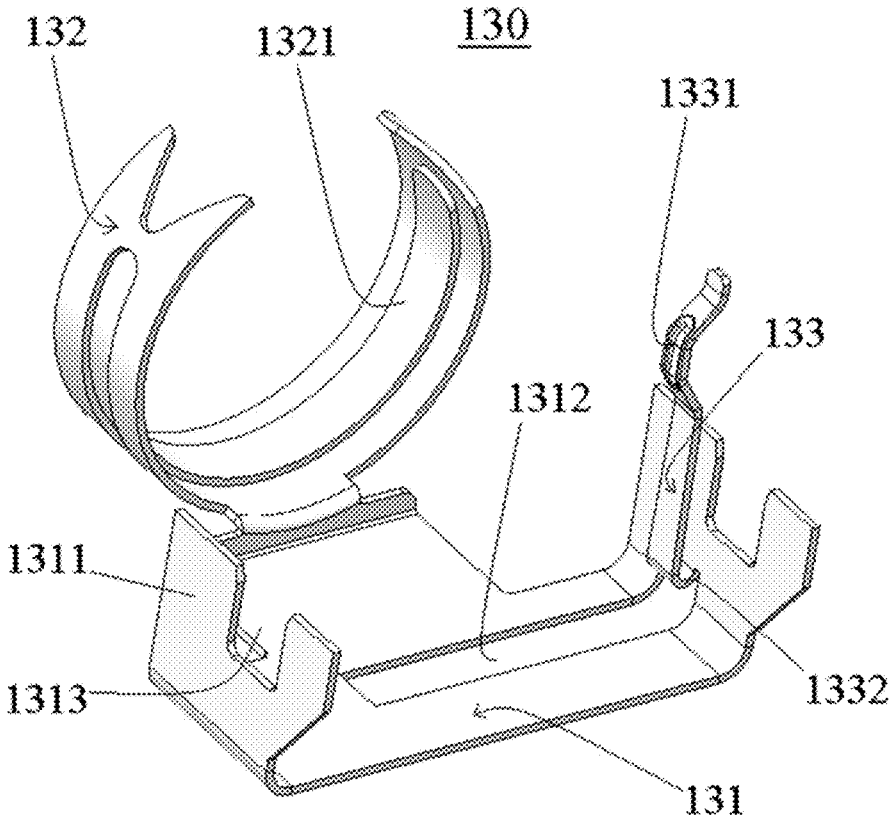
FIG. 6 is a perspective view showing a structure of a metal shielding member according to one exemplary embodiment of the present disclosure.
Figure 7:
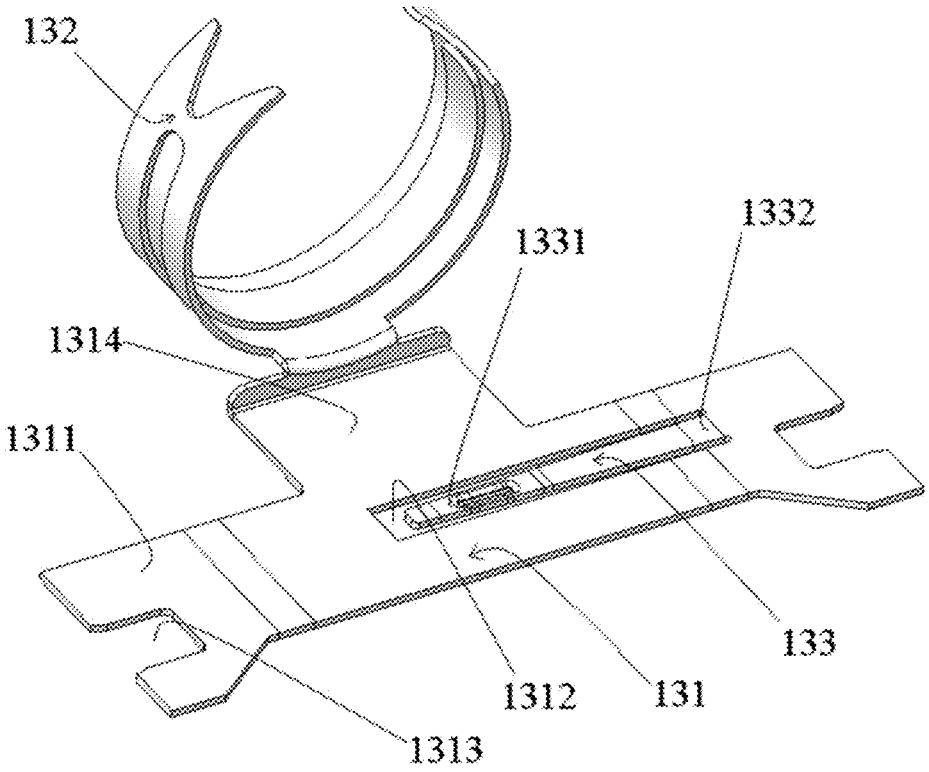
FIG. 7 is a perspective view of a body of the metal shielding member shown in FIG. 6 in an unfold state.

FIG. 6 shows a structure of a metal shielding member according to one exemplary embodiment of the present disclosure, and FIG. 7 is a perspective view of a main body of the metal shielding member shown in FIG. 6 in an unfold state. As described above, the metal shielding member 130 may be used in the electrical connector 100 for connecting the cable 200 having the metal braid layer 202 to the electrical apparatus. As shown in the figures, the metal shielding member 130 may comprise a main body 131, a clamping portion 132 configured to clamp and electrically contact the metal braid layer of the cable, and an elongate elastic terminal 133 configured to electrically contact the grounding terminal 1501 of the electrical connector.

In one example, the main body 131 is substantially U-shaped, and has a flat portion and two end portions 1311 approximately perpendicular to the flat portion. The elastic terminal 133 is formed by punching a part from the flat portion of the main body 131, and has one end connected and integrated with the main body 131 and an opposite free end. For example, a part of the flat portion of the main body 131, such as an edge or a middle part of the flat portion, may be first punched to form an elongate member with one end connected with the main body. Then the formed elongate member is configured into the elastic terminal 133 having a desired shape. When the middle part of the flat portion is punched, a notch or opening groove 1312 is formed in the flat portion at a position corresponding to the elastic terminal, as shown in FIGS. 6 and 7. In the unfolded state shown in FIG. 7, the elastic terminal 133 is located within the opening groove 1312, and may have a width smaller than or equal to that of the opening groove 1312. According to this embodiment of the present disclosure, the elastic terminal 133 is formed by punching a part of a material from which the main body 131 of the shielding member is formed. Thus no additional material is required to form the elastic terminal, so that material utilization can be effectively improved and reduce cost.

As shown in FIGS. 5 and 6, a free end of the elastic terminal 133 has a curved structure which has an abutment portion or a protrusion 1331 configured for contacting the grounding terminal 1501 of the electrical connector. For example, as shown in FIGS. 4-6, the abutment portion or protrusion 1331 may protrude towards the grounding terminal 1501 of the female contact member 151 and thus is slightly deformed when being arranged between the female contact member 151 and the body of the electrical connector so as to achieve a better contact connection with the grounding terminal 1501 by making use of its elasticity.

As shown in FIGS. 3, 6 and 7, the clamping portion 132 of the shielding member 130 may be connected to the main body 131 through an extension portion 1314 perpendicularly extending from the flat portion of the main body 131, for example, integrated with the main body 131. The clamping portion 132 may have a substantially C-shaped configuration for fitting over the outer profile of the cable. For example, the C-shaped configuration may have an inner diameter slightly smaller than an outer diameter of the cable with the outermost insulating layer being peeled off to expose the metal shielding layer, so that when the C-shaped configuration is fitted over the cable, the C-shaped configuration will contract inwardly through its elasticity so as to tightly clamp and contact the metal shielding layer of the cable. In one example, as shown in FIGS. 6 and 7, an inner surface of the clamping portion 132 for clamping the metal braid layer is formed with a raised ridge structure 1321 for engaging with an outer surface of the metal braid layer. For example, the outer surface of the C-shaped configuration may be pressed so as to form a raised ridge having a width on the inner surface of the C-shaped configuration.

As shown in FIGS. 6 and 7, the main body 131 of the shielding member 130 may be substantially U-shaped, and has two end portions 1311 each being formed with an engagement opening 1313 for snap-fitting with a corresponding protruding portion shown in FIG. 3 of the electrical connector so that the shielding member 130 is fitted on the body 110 of the electrical connector. It will be understood by those skilled in the art that the material and shape of the metal shielding member are not limited to those illustrated in the figures. For example, the metal shielding member may be formed by integrally stamping a plate material.

According to embodiments of the present disclosure, the metal shielding member is formed with an elastic terminal with the grounding connection of the metal shielding layer of the cable achieved through the elastic terminal and the elastic terminal is formed by punching a part of a material from the flat portion of the body of the shielding member. Thus, no additional material is required to form the elastic terminal. The material utilization can be effectively improved so as to reduce cost.

Although several exemplary embodiments of the general inventive concept have been shown and described, it will be appreciated by those skilled in the art that various changes or modifications may be made in these embodiments without departing from the principles and spirit of the present invention, the scope of which is defined in the claims and their equivalents. It should be noted that the term "comprise" does not exclude other elements or steps and the term "a" or "an" does not exclude a plurality of elements or steps.

What is claimed is:

1. An electrical connector adapted to connect a cable having a metal braid layer with an electrical apparatus having an apparatus housing, comprising:

a body adapted to be mounted on the apparatus housing;

a cover fitted on the body;

a metal shielding member fitted on the body and partially covered by the cover and having a clamping portion clamping a metal braid and in electrical contact with the metal braid and an elastic terminal in electrical contact with a grounding terminal; and a terminal module arranged within the body and having the grounding terminal for a grounding connection via the electrical apparatus and a plurality of signal terminals for supplying electrical current from the cable to the electrical apparatus.

2. The electrical connector according to claim 1, wherein the grounding terminal is adapted to be electrically connected with a grounding line of the electrical apparatus.

3. The electrical connector according to claim 1, wherein the grounding terminal is adapted to be electrically connected with the apparatus housing of the electrical apparatus.

4. The electrical connector according to claim 3, wherein the body is adapted to be fixed onto the apparatus housing via metal screws and the grounding terminal is electrically connected to one of the metal screws by a metal wire.

5. The electrical connector according to claim 3, wherein the grounding terminal and the plurality of signal terminals all have a female contact member and a male contact member inserted into the female contact member with the female contact member of the grounding terminal electrically contacting the elastic terminal of the metal shielding member and the male contact member of the grounding terminal adapted for the grounding connection.

6. The electrical connector according to claim 5, wherein the male contact member has an insertion end inserted into the female contact member and a receiving end receiving the grounding line of electrical apparatus.

7. The electrical connector according to claim 6, wherein the body has an upper body portion and a lower body portion, with the upper body portion fitted on the lower body portion and receiving the female contact member, and the male contact member partially received within the lower body portion so that the insertion end protrudes from the lower body portion as inserted into the female contact member.

8. The electrical connector according to claim 7, wherein a height by which the insertion end of the male contact member of the grounding terminal protrudes from the lower body portion is larger than a height by which the insertion ends of the male contact members of the signal terminals protrude from the lower body portion, so that when the upper body portion is fitted on the lower body portion, the insertion end of the male contact member of the grounding terminal is inserted into the corresponding female contact member before the insertion ends of the male contact members of the signal terminals.

9. The electrical connector according to claim 7, wherein the elastic terminal is received within the upper body portion and contacts an outer wall of the female contact member of the grounding terminal.

10. The electrical connector according to claim 3, wherein the metal shielding member further includes a substantially U-shaped main body having a flat portion and two end portions substantially perpendicular to the flat portion, and the elastic terminal is formed by punching a part from the flat portion and is connected and integrated at one end thereof with the main body.

11. The electrical connector according to claim 10, wherein the flat portion has an opening groove formed by punching the elastic terminal.

12. The electrical connector according to claim 10, wherein a free end of the elastic terminal has a curved structure having a protrusion in contact with the grounding terminal.

13. The electrical connector according to claim 3, wherein the clamping portion has a substantially C-shaped configuration.

14. The electrical connector according to claim 10, wherein the clamping portion is connected to the main body through an extension portion extending perpendicularly from the flat portion of the main body.

15. The electrical connector according to claim 3, wherein a surface of the clamping portion for clamping the metal braid layer is formed with a raised ridge structure engaging an outer surface of the metal braid layer.

16. An electrical connector adapted to connect a cable having a metal braid layer with an electrical apparatus, the electrical connector comprising:

a body adapted to be mounted on the electrical apparatus;

a cover fitted on the body;

a terminal module within the body and having:

(a) a grounding terminal for a grounding connection via the electrical apparatus, and (b) a plurality of signal terminals for supplying electrical current from the cable to the electrical apparatus, and, a metal shielding member:

(a) fitted on the body, (b) at least partially covered by the cover, and (c) having:

(1) a clamping portion adapted to clamp and be in electrical contact with the metal braid layer, and (2) an elastic terminal in electrical contact with the grounding terminal of the terminal module.

17. An electrical connector according to claim 16, wherein the grounding terminal and the signal terminals all have a female contact member and a male contact member in the female contact member, with the female contact member of the grounding terminal in electrical contact with the elastic terminal of the metal shielding member and the male contact member of the grounding terminal grounded.

18. An electrical connector according to claim 16, wherein:

(a) the body includes a lower body portion and an upper body portion fitted on the lower body portion, (b) the female contact members of the grounding terminal and the signal terminals extend into the upper body portion, and (c) the male contact members of the grounding terminal and the signal terminals extend at least partially into the lower body portion, with ends protruding from the lower body portion.

19. An electrical connector according to claim 18, wherein a height by which the protruding end of the male contact member of the grounding terminal protrudes from the lower body portion is larger than a height by which the protruding ends of the male contact members of the signal terminals protrude from the lower body portion, so that when the upper body portion is fitted on the lower body portion, the protruding end of the male contact member of the grounding terminal is inserted into the corresponding female contact member before the protruding ends of the male contact members of the signal terminals.

20. An electrical connector according to claim 16, wherein the metal shielding member has a substantially U-shaped main body having a flat portion and two end portions extending substantially perpendicular to the flat portion, with one of the end portions having the elastic terminal.

21. An electrical connector according to claim 16, wherein the clamping portion of the metal shielding member has a substantially C-shaped configuration.

22. The electrical connector according to claim 21, wherein the metal shielding member has an extension portion extending perpendicularly from the flat portion of the main body of the metal shielding member connecting the main body of the metal shielding member and the clamping portion of the metal shielding member.

23. The electrical connector according to claim 21, wherein the surface of the clamping portion of the metal shielding member that is adapted to clamp and be in electrical contact with the metal braid has a raised ridge.

* * * * *